United States Patent [19]

Richards

[11] Patent Number: 4,771,560

[45] Date of Patent: Sep. 20, 1988

[54] SIGN

[76] Inventor: Anastasia Richards, 6200 Francis Road, Richmond, British Columbia, Canada, V7C 1K5

[21] Appl. No.: 108,243

[22] Filed: May 26, 1987

Related U.S. Application Data

[63] Continuation of Ser. No. 640,416, Aug. 13, 1984, abandoned.

[51] Int. Cl.[4] ..... G09F 15/00

[52] U.S. Cl. ..... 40/607

[58] Field of Search ..... 40/607, 606, 584, 610

[56] References Cited

U.S. PATENT DOCUMENTS

| | | | |
|---|---|---|---|
| 2,914,874 | 12/1959 | Stein | 40/607 |
| 2,939,236 | 6/1960 | Stein | 40/607 |
| 3,370,369 | 2/1968 | Look | 40/607 |
| 4,009,532 | 3/1977 | Thomas | 40/606 |
| 4,259,803 | 4/1981 | Siller | 40/607 |
| 4,318,238 | 3/1982 | Macarle, Jr. | 40/607 |

FOREIGN PATENT DOCUMENTS

| | | | |
|---|---|---|---|
| 561943 | 3/1957 | Italy | 40/607 |
| 704578 | 3/1965 | Canada | 40/606 |

*Primary Examiner*—Gene Mancene
*Assistant Examiner*—Cary E. Stone
*Attorney, Agent, or Firm*—Townsend & Townsend

[57] ABSTRACT

A sign comprising a reinforcement member adapted to be located on a post and a waterproof cover located on the reinforcing member. The sign is easy and cheap to make and is weatherproof.

5 Claims, 1 Drawing Sheet

SIGN

This is a continuation Ser. No. 640,416, filed 8/13/84, now abandoned.

FIELD OF THE INVENTION

This invention relates to a sign and finds particular application as a sign, to be used during an election campaign.

DESCRIPTION OF THE PRIOR ART

Conventional signs and placards used to display messages or slogans, especially during election times, usually simply comprises a piece of paper or cardboard fastened to a suitable length of wood. Although such designs are relatively easy to manufacture they are usually fairly expensive and there are a number of disadvantages in their use.

Most signs of this type are fragile and are easily buffeted and broken by winds when displayed outdoors. The signs are not waterproof so that even a brief shower of rain can cause the ink to run and thus make the message illegible. The weather, particularly rain, can also result in curling of the ends of the sign so that it cannot be viewed properly. Furthermore it is extremely rare for such signs to be re-usable because of their relative fragility and poor resistance to the weather.

Although it would appear easy to solve some of the above problems by making the signs from a sturdy material, for example wood, it should be remembered that this involves substantial increase in cost and makes for a substantially heavier, more cumbersome sign. Bearing in mind the huge number of signs used during an election campaign expense is a significant factor. Furthermore increasing the weight of a sign is not desirable where, for example, the sign is to be carried in a parade.

SUMMARY OF THE INVENTION

The present invention therefore seeks to provide a sign that can be easily assembled, is cheap to manufacture, of reasonably sturdy construction and completely waterproof. More specifically the present invention provides a sign adapted to be attached to a post. The sign comprises a reinforcement member to be located on the post and a waterproof cover located on the reinforcing member.

DRAWINGS

Aspects of the invention are illustrated, merely by way of example, in the accompanying drawings in which:

FIG. 1 is a perspective view of a sign according to the present invention; and FIG. 2 is an exploded view of the sign of FIG. 1.

DESCRIPTION OF THE PREFERRED EMBODIMENTS

Figure 1:
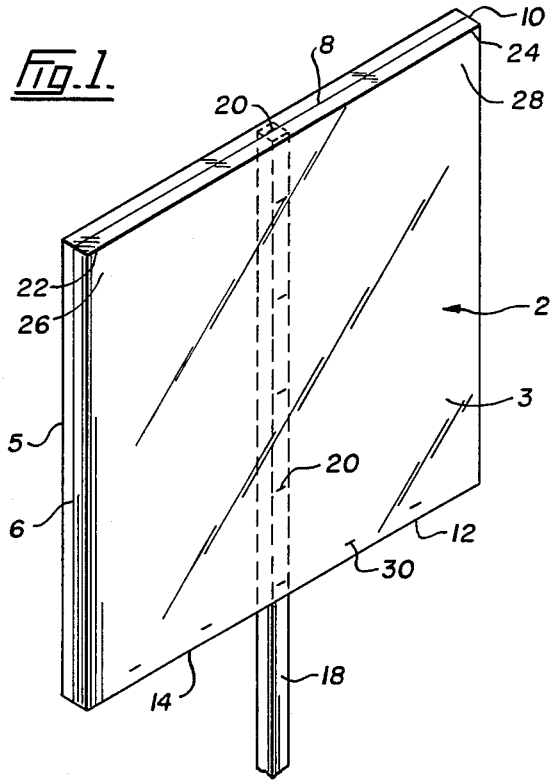

The drawings show a sign comprising a waterproof cover 2 having a front 3 and a back 5. The front and back, each comprise a single piece of waterproof plastic, preferably polyethylene. They are preferably bonded together along the edges 6, 8 and 10. Edge 12 is unbonded to form an opening 14. Slogans, messages and the like are printed on one or both surfaces of the sign. The printing on waterproof surfaces, for example polyethylene, is well known. Weatherproof printing can easily be obtained using conventional methods in the art that will not be described here.

Figure 2:
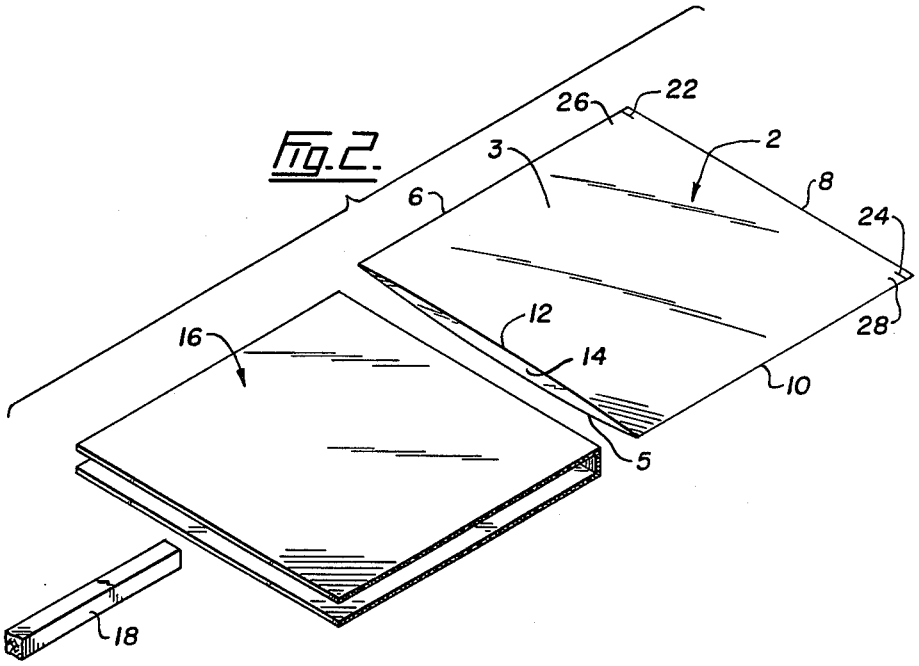

There is a reinforcing member 16 comprising, in the illustrated embodiment, a single piece of reinforced cardboard folded in the manner shown best in FIG. 2, that is with first and second spaced surfaces and a bridging member joining the surfaces. In use the reinforcement member is mounted on a post 18. Staples 20 are used to locate the reinforcement member 16 on the post 18. Staples 20 are typically applied after the cover 2 has been placed over member 16 so that they act to hold the complete sign together. The frame is slidably received in opening 14 of sign 2 to provide structural rigidity to the sign. Thus the dimensions of the reinforcement member 16 and the cover 2 are similar with the cover 2 being slightly larger and thus able to receive the reinforcement member 16. Cuts 22 and 24 formed in corners 26 and 28 of the cover 2 allow the cover to assume the rectangular shape of the frames. Staples 30 along the lower edge 14 of the waterproof cover 2 may be used to prevent accidental disengagement of the reinforcement member 16 from the cover 2.

The sign is economical to make yet is sturdy and re-usable. It is vastly more weather resistant than any prior art sign and yet is about 50% cheaper to manufacture. The reinforcement member 16 is desirably of reinforced cardboard known commonly as corrugated board, that is it comprises two sheets of flat card separated by a piece of corrugated card.

With regard to the preferred use as a sign for use in election campaigns, traditionally during Canadian elections a third of a campaign office is set aside for assembling lawn signs. This is no longer necessary with the invention. Further the construction and installing of the signs was done by men because of the weight of the signs and this meant the signs were made and installed on weekends. Because of the lightness and ease of construction this is no longer the case. Women, teenagers and men can all make and install the new sign.

Because of the bulk of prior art signs vans were used to transport the signs and a sign crew was used to install the signs. With the sign of the invention one person carrying the signs in a car trunk can do the job.

As further advantages printing on plastic sheet has better fade-resistance than printing on board. Further plastic reflects light more efficiently to attract attention. The material used in the sign of the invention can also be used to construct large banners to be used in office windows and in parades. The cost again is slight compared with hundreds of dollars for prior art banners.

I claim:

1. A sign comprising:

a post having opposed first and second sides and a top;

a reinforcement member of reinforced cardboard located on the post, the reinforcement member comprising a generally U-shaped member having a first surface to be received on the first side of the post, a second surface to be received on the second side of the post and a bridging member extending between the first and second surfaces to contact the top of the post; and a waterproof cover located on the reinforcement member;

the waterproof cover and reinforcement member being of similar dimensions with the waterproof cover being slightly larger and thus able to receive the reinforcement member.

2. A sign as claimed in claim 1 in which the cover has a front and a back and is open at one side and closed at three, the open side being dimensioned to slide over the reinforcement member.

3. A sign as claimed in claim 2 in which the cover is of polyethylene.

4. A sign as claimed in claim 1 in which the reinforcement member and the waterproof cover are stapled on the post.

5. A sign as claimed in claim 1, including staples at the bottom edge of the sign, attaching the cover to the reinforcement member.

* * * * *